US008833968B2

(12) United States Patent
Kung et al.

(10) Patent No.: US 8,833,968 B2
(45) Date of Patent: Sep. 16, 2014

(54) LED ILLUMINATING DEVICE

(75) Inventors: Te-Yuan Kung, New Taipei (TW); Jun-Jie Cui, Shenzhen (CN); Qi-Qiang Lei, Shenzhen (CN); Zhao-Yu Wang, Shenzhen (CN); Tsang-Chiang Yang, New Taipei (TW); Wen-Hsiang Lu, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 170 days.

(21) Appl. No.: 13/447,304

(22) Filed: Apr. 16, 2012

(65) Prior Publication Data

US 2013/0170202 A1 Jul. 4, 2013

(30) Foreign Application Priority Data

Dec. 30, 2011 (CN) ..... 2011 1 0453405

(51) Int. Cl.
*F21V 7/00* (2006.01)
*F21V 13/04* (2006.01)

(52) U.S. Cl.
USPC ..... 362/235

(58) Field of Classification Search
CPC ..... F21V 1/00; F21V 3/00; F21V 5/00; F21V 7/00; F21V 11/14; F21V 13/04; F21V 3/02; F21V 5/048; F21V 3/0472; F21K 9/135
See application file for complete search history.

(56) References Cited

U.S. PATENT DOCUMENTS

2011/0141747 A1* 6/2011 Biar ..... 362/311.06
2011/0254426 A1* 10/2011 Wang ..... 313/46
2012/0313502 A1* 12/2012 Hu ..... 313/113
2013/0044491 A1* 2/2013 Chen et al. ..... 362/294

* cited by examiner

*Primary Examiner* — Bao Q Truong
(74) *Attorney, Agent, or Firm* — Novak Druce Connolly Bove + Quigg LLP

(57) ABSTRACT

An LED illuminating device includes a base, an LED substrate mounted on the base, at least one LED on the substrate and an envelope fixed on the base. The envelope includes a plurality of transmission regions and a plurality of reflective regions. The lights beams emitted by the LED reaches the envelope. A first portion of the light beams reaching transmission regions can pass therethough. A second portion of the light beams are internally reflected in multiple times by the reflective regions until they finally escape to outside through the transmission regions. The direction of the light beams can reach various locations of each of the transmission regions at various angles.

9 Claims, 5 Drawing Sheets

LED ILLUMINATING DEVICE

BACKGROUND

1. Technical Field

The present disclosure relates to light emitting diode (LED) illuminating devices, especially to an LED illuminating device with large light divergence angle.

2. Description of Related Art

Compared to many other kinds of illuminating devices, LEDs have many advantages, such as high luminous efficiency, low power consumption, and long service life. Yet, LEDs still have disadvantages. Because light emitted by LEDs is directional, the light divergence angle of an LED illuminating device is generally less than that of some other kinds of illuminating devices, such as an electric incandescent lamp, a fluorescent lamp and a halogen lamp.

Referring to FIG. 1, the light divergence angle of a typical LED illuminating device 401 is about 60 degrees, which is less than an electric incandescent lamp. Referring to FIG. 2, a conventional ring-shaped LED illuminating device including a number of substrates is shown. With the configuration of multiple substrates, the light divergence angle of the LED illuminating device increases. However, more heat is produced by the LEDs (shown as arrows) on the substrates, which requires an efficient heat dissipation device, adding cost and complexity to structure of the LED illuminating device.

Therefore, what is needed is an LED illuminating device with large light divergence angle.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The disclosure, including the accompanying, is illustrated by way of example and not by way of limitation. It should be noted that references to "an" or "one" embodiment in this disclosure are not necessarily to the same embodiment, and such references mean at least one.

Figure 1:
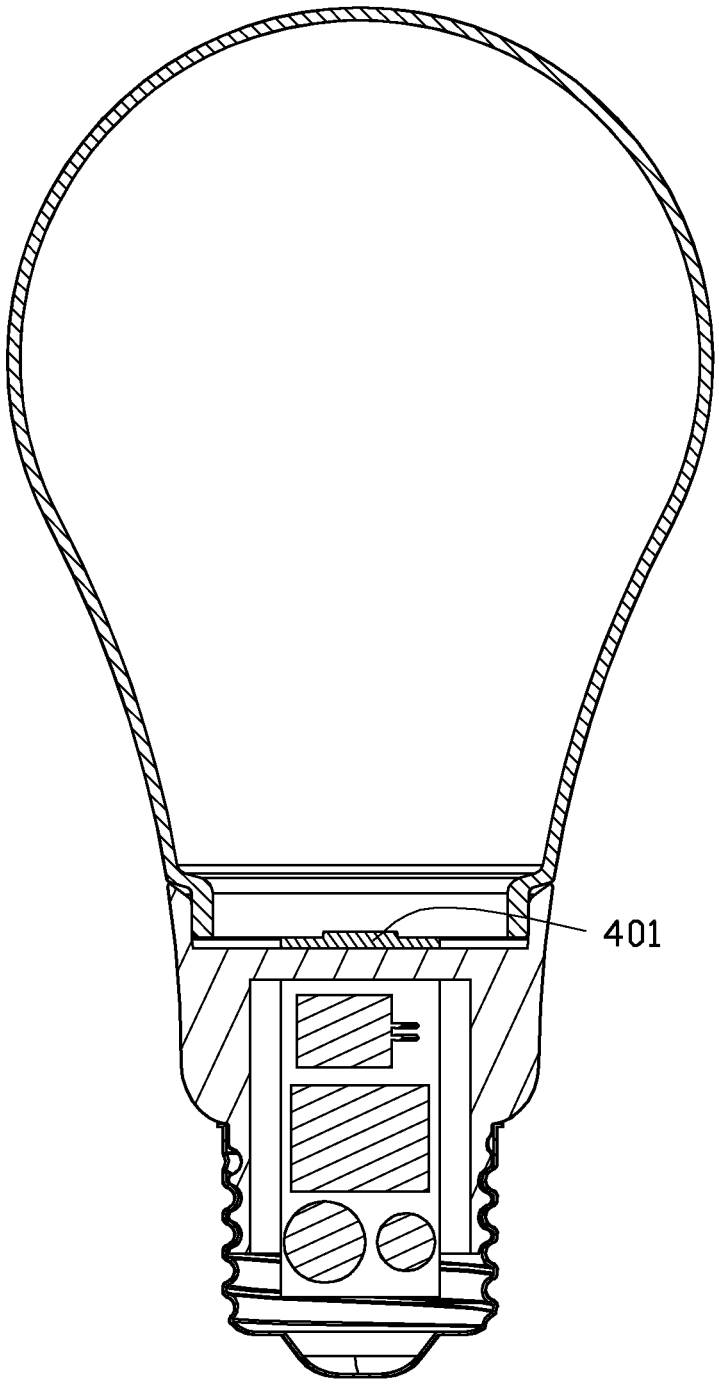
FIG. 1 (RELATED ART)
FIG. 1 is a schematic, cross-sectional view of a conventional LED illuminating bulb.
Figure 2:
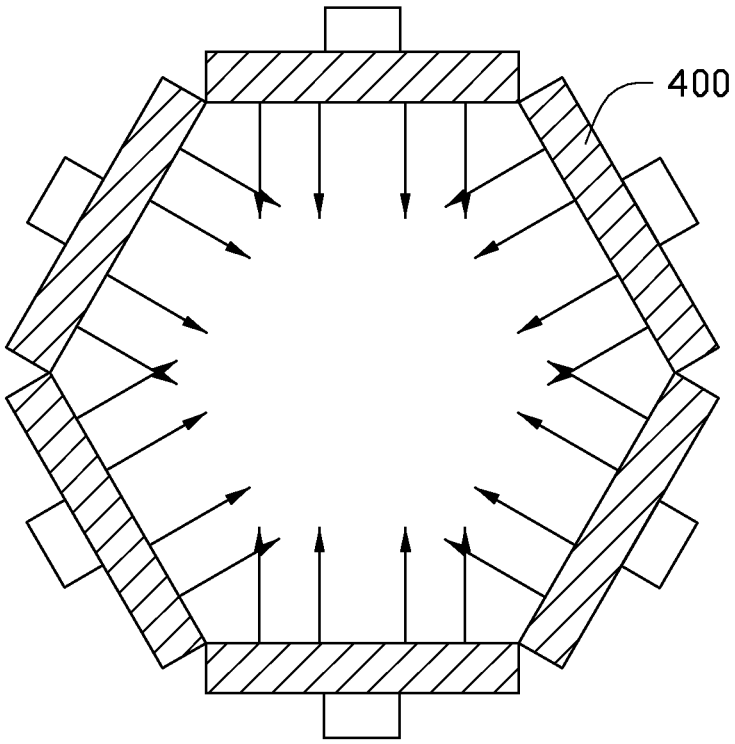
FIG. 2 (RELATED ART)
FIG. 2 is a schematic view showing a conventional ring shaped LED illuminating device.
Figure 3:
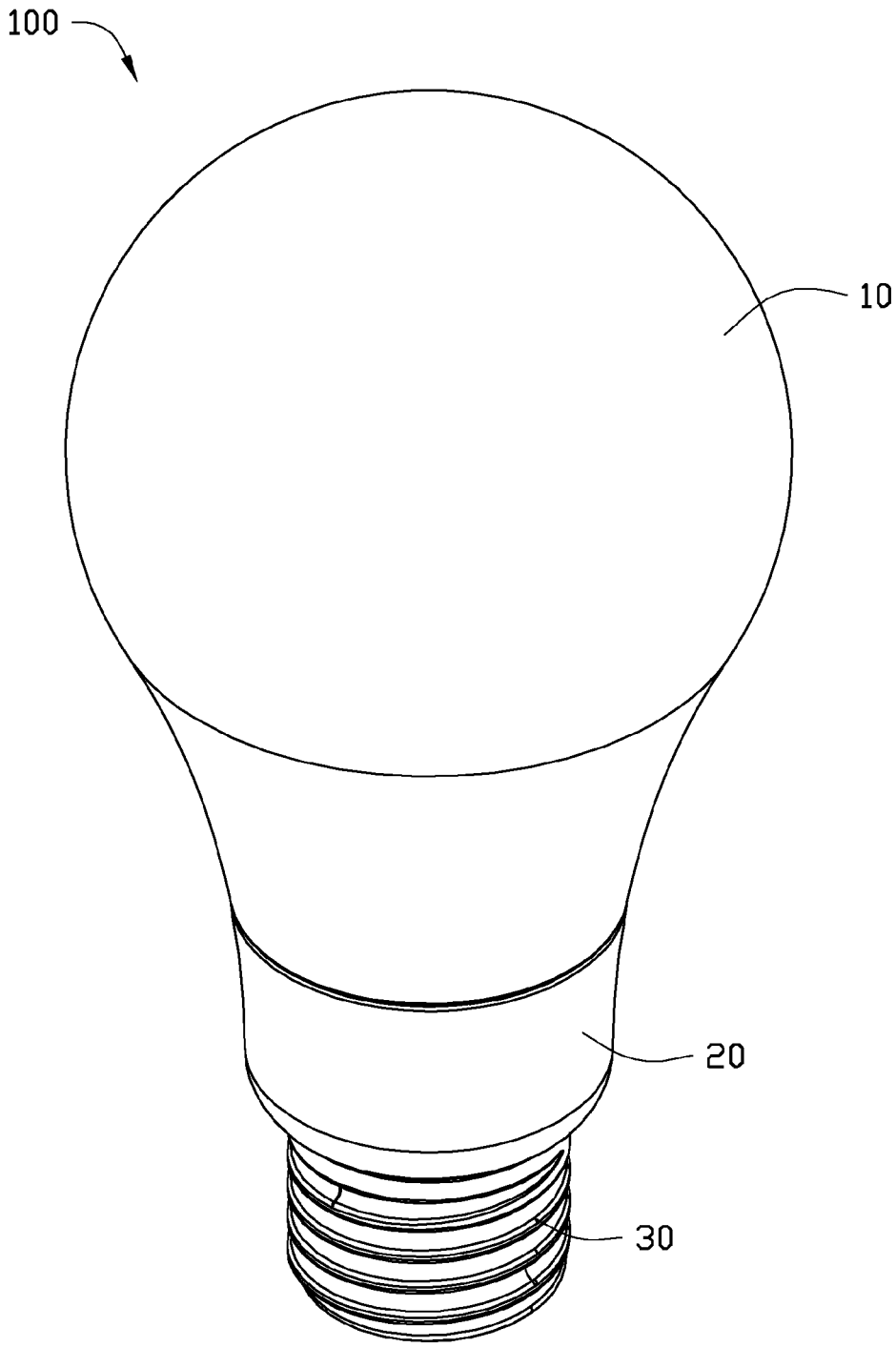
FIG. 3 is schematic view showing an LED illuminating device in accordance with an exemplary embodiment.
Figure 4:
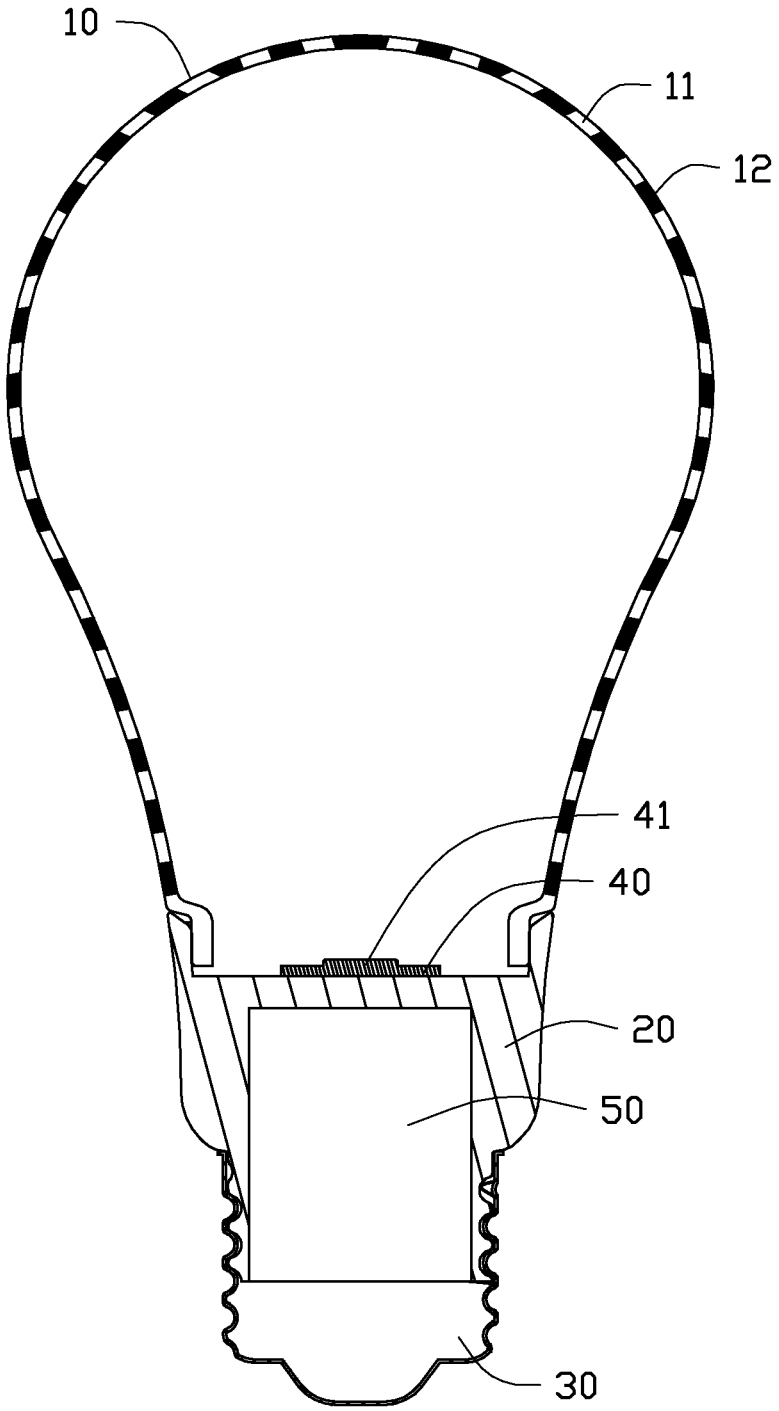
FIG. 4 is a schematic, cross-sectional view of the LED illuminating device of FIG. 3.
Figure 5:
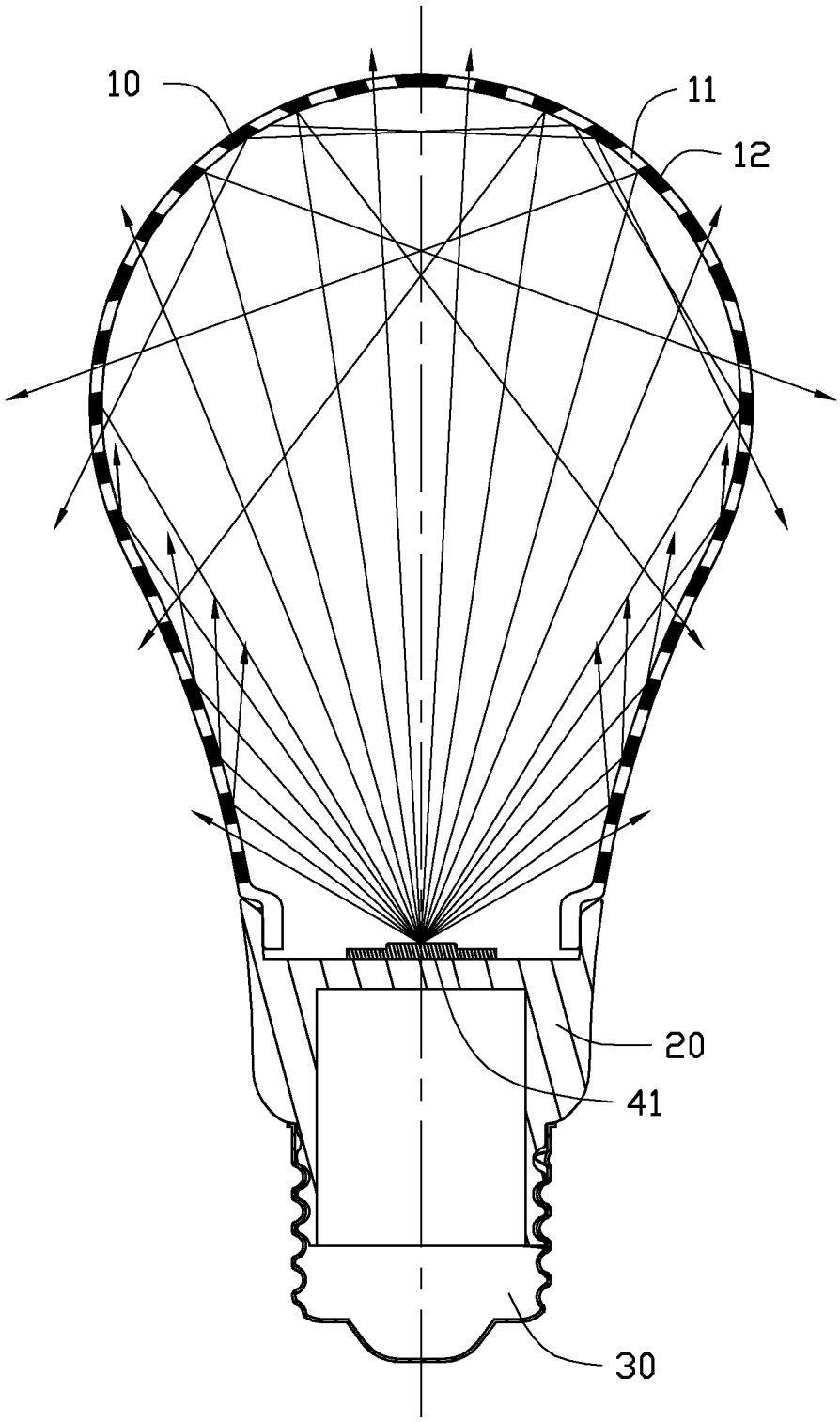
FIG. 5 is a schematic, cross-sectional view showing light paths of the LED illuminating device of FIG. 3.

Referring to FIGS. 3 and 4, a light emitting diode (LED) illuminating device 100 according to an embodiment is disclosed. The LED illuminating device 100 includes an envelope 10, a base 20, and a connector 30. The envelope 10 and the connector 30 are respectively attached to two opposite ends of the base 20. The connector 30 is used to mate with a coupling connector to electrically connect the device 100 to a power source.

The device 100 further includes an LED substrate 40, and a driving circuit module 50. At least one LED 41 is arranged on the LED substrate 40. In this embodiment, only one LED 41 is arranged on the LED substrate 40. The driving circuit module 50 is accommodated in the base 20 and electrically connected to the connector 30 and the LED substrate 40.

The envelope 10 is fixed on the base 20 by any suitable connection techniques, such as threaded connection, snap connection or gluing. The light beams emitting from the LEDs 41 pass through the envelope 10 and spread out. The heat generated by the LEDs 41 is transferred via the LED substrate 40 to the base 20 and finally transferred outside of the base 20. In the embodiment, the base 20 is made of metal with good heat conductivity, such as copper or aluminum. In another embodiment, the base plate 20 can be made of ceramic, and the base 20 can further include a number of cooling fins arranged on a circumferential wall of the base 20 to increase the heat dissipation area.

The envelope 10 is shaped like a bulb and includes a number of transmission regions 11 and a number of reflective regions 12. In the embodiment, the transmission regions 11 and the reflective regions 12 are alternatively arranged. Some of the light beams emitted by the LED 41 reach the transmission regions 11 directly, and pass though the transmission regions 11 and spread out. The remaining light beams emitted by the LED 41 reach the reflective regions 12, and are reflected back. Part of the reflected light travels to the transmission regions 11 and can spread out via passing though the transmission regions 11. The remaining reflected light travels to the reflective regions 12 and will be reflected again and repeat the above process until they finally spread outside through the transmission regions 11.

Some of the light beams emitted by the LED 41 are internally reflected for multiple times by the reflective regions 12 until they finally escape to outside through the transmission regions 11. The directions of the light beams are changed. Because of the multiple reflections, the light beams emitted by the LED 41 can reach various locations of each of the transmission regions 11 at various angles. The light divergence angle of the LED illuminating device 100 increases correspondingly.

The transmission regions 11 and the reflective regions 12 can be formed on the envelope 10 via many methods. In the embodiment, the envelope 10 is made of transparent plastic material, and a printing process, a chemical plating or depositing process can be employed to form a number of discrete reflective films on the internal surface of the envelope 10. The number of the discrete reflective film act as the reflective regions 12. The reflective film can be a metal reflective coating chosen from the group consisting of an aluminum coating, a gold coating and a silver coating, arranged on the internal surface of the envelope 10. The transmission regions 11 are alternately arranged with the reflective regions 12. In other embodiment, the envelope 10 may be made of transparent plastic material, and a reflective membrane with openings may be attached on the internal or external surface of the envelope 10. Light beams can pass through the openings of the reflective membrane. The openings of the reflective membrane act as the transmission regions 11. The reflective membrane between the openings acts as the reflective regions 12.

In other embodiment, the envelope 10 may be a metal bulb, and the internal surface of the metal bulb can be polished to form a mirror-finished surface, and light beams can be reflected by the internal surface of the metal bulb. The envelope 10 further defines a number of openings extending through surfaces of the envelope. The openings can be formed by punching. Light beams can spread out from the openings of the envelope 10 to outside, and the openings act as the transmission regions 11, and the internal surface of the envelope 10 between the openings act as the reflective regions 12.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An LED illuminating device comprising:

a base;

an LED substrate mounted on the base;

at least one LED arranged on the LED substrate;

a driving circuit module accommodated in the base and electrically connected with the at least one LED; and an envelope fixed on the base and comprising a plurality of transmission regions and a plurality of reflective regions, the plurality of transmission regions allowing a first portion of light beams emitted by the at least one LED to pass therethrough, the plurality of reflective regions being configured to reflect a second portion of the light beams emitted by the at least one LED and allowing light beams emitted by the at least one LED to reach various locations of the plurality of transmission regions at various angles; and wherein the plurality of reflective regions are discrete reflective films formed on an internal surface of the envelope.

2. The LED illuminating device of claim 1, wherein the envelope is made of transparent plastic or glass.

3. The LED illuminating device of claim 1, wherein the discrete reflective film are a metal reflective coating chosen from the group consisting of an aluminum coating, a gold coating and a silver coating.

4. An LED illuminating bulb comprising:

a base;

at least one LED on the base;

a driving circuit module accommodated in the base and electrically connecting with the least one LED; and an envelope fixed on the base and comprising a plurality of transmission regions and a plurality of reflective regions between the transmission regions, the plurality of transmission regions allowing a first portion of light beams emitted by the at least one LED to pass therethrough, the plurality of reflective regions being configured to reflect a second portion of the light beams emitted by the at least one LED, allowing light beams emitted by the at least one LED to reach various locations of the plurality of transmission regions at various angles; and wherein the plurality of reflective regions are discrete reflective films formed on an internal surface of the envelope.

5. The LED illuminating device of claim 4, wherein the envelope is made of transparent plastic or glass.

6. The LED illuminating device of claim 4, wherein the discrete reflective films are a metal reflective coating chosen from the group consisting of an aluminum coating, a gold coating and a silver coating.

7. An LED illuminating device comprising:

a base;

an LED substrate mounted on the base;

at least one LED arranged on the LED substrate;

a driving circuit module accommodated in the base and electrically connected with the at least one LED; and an envelope fixed on the base and comprising a plurality of transmission regions and a plurality of reflective regions, the plurality of transmission regions allowing a first portion of light beams emitted by the at least one LED to pass therethrough, the plurality of reflective regions being configured to reflect a second portion of the light beams emitted by the at least one LED and allow light beams emitted by the at least one LED to reach various locations of the plurality of transmission regions at various angles; and wherein the plurality of reflective regions are discrete reflective regions formed on a surface of the envelope.

8. The LED illuminating device of claim 7, wherein the discrete reflective regions are a metal reflective coating chosen from the group consisting of an aluminum coating, a gold coating, and a silver coating.

9. The LED illuminating device of claim 7, wherein the envelope is made of metal, the envelope defines a plurality of openings acting as the transmission regions.

* * * * *